US009353562B2

(12) United States Patent
Oshima et al.

(10) Patent No.: US 9,353,562 B2
(45) Date of Patent: May 31, 2016

(54) DOOR OPENING AND CLOSING DEVICE

(71) Applicant: SUGATSUNE KOGYO CO., LTD., Tokyo (JP)

(72) Inventors: Kazuyoshi Oshima, Tokyo (JP); Kazuaki Kashiwaguma, Tokyo (JP); Masaya Suzuki, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 14/431,100

(22) PCT Filed: Sep. 20, 2013

(86) PCT No.: PCT/JP2013/075519
§ 371 (c)(1),
(2) Date: Mar. 25, 2015

(87) PCT Pub. No.: WO2014/050749
PCT Pub. Date: Apr. 3, 2014

(65) Prior Publication Data

US 2015/0240546 A1 Aug. 27, 2015

(30) Foreign Application Priority Data

Sep. 25, 2012 (JP) ..... 2012-210302

(51) Int. Cl.
*E05F 1/10* (2006.01)
*E05F 1/14* (2006.01)
*E05D 15/40* (2006.01)

(52) U.S. Cl.
CPC ..... *E05F 1/1041* (2013.01); *E05F 1/14* (2013.01); *E05D 15/401* (2013.01); *E05Y 2800/22* (2013.01); *E05Y 2900/20* (2013.01); *Y10T 16/585* (2015.01)

(58) Field of Classification Search
CPC ..... Y10T 16/5383; Y10T 16/53832; Y10T 16/53833; Y10T 16/53834; Y10T 16/585; Y10T 16/299; E05F 1/08; E05F 1/10; E05F 1/1041; E05F 1/1091; E05F 1/12; E05F 1/1223; E05F 1/1246; E05F 1/1253; E05F 1/1261; E05F 1/1292; E05F 1/14; E05D 11/1021; E05D 3/12; E05D 3/14; E05D 3/16; E05D 15/40; E05D 15/401; E05D 15/405; E05D 15/406; E05D 15/42; E05D 15/58; E05D 15/565; E06B 3/5045; E05Y 2800/22; E05Y 2900/20; E05Y 2900/202; E05Y 2900/208; E05Y 2900/21; E05Y 2201/21; E05Y 2201/264
See application file for complete search history.

(56) References Cited

U.S. PATENT DOCUMENTS 3,575,483 A * 4/1971 Church ..... E06B 3/385 312/325
4,083,082 A * 4/1978 Holmes ..... E05D 3/142 16/288
4,658,473 A * 4/1987 Schema ..... E05F 1/1261 16/286
5,904,411 A * 5/1999 Hayakawa ..... E05D 15/582 16/289
7,065,833 B2 * 6/2006 Kropf ..... E05D 3/142 16/286
7,178,202 B2 * 2/2007 Hirtsiefer ..... E05D 3/14 16/286
7,478,891 B2 * 1/2009 Hollenstein ..... E05F 1/1058 312/319.2
8,894,162 B2 11/2014 Kashiwaguma
2001/0039762 A1 * 11/2001 Giovannetti ..... E05F 1/1091 49/246
2004/0108311 A1 * 6/2004 de Rooij ..... H05B 6/1245 219/624
2007/0124893 A1 * 6/2007 Brustle ..... E05F 1/1075 16/296
2008/0121490 A1 * 5/2008 Dubach ..... E05F 1/1058 192/17 D
2010/0101052 A1 * 4/2010 Waltemate ..... E05D 3/16 16/297
2010/0109497 A1 * 5/2010 Blersch ..... E05D 3/18 312/405
2012/0000130 A1 1/2012 Kashiwaguma

| | | | | |
|---|---|---|---|---|
| 2012/0079684 | A1* | 4/2012 | Tumler | E05D 11/10 16/277 |
| 2012/0084944 | A1* | 4/2012 | Hirtsiefer | E05D 3/14 16/302 |
| 2013/0031746 | A1* | 2/2013 | Hasegawa | E05D 3/14 16/50 |

FOREIGN PATENT DOCUMENTS

| | | | | |
|---|---|---|---|---|
| AT | DE 3202513 | A1 * | 9/1982 | E05D 3/183 |
| DE | 3124457 | A1 * | 12/1982 | E05B 65/0046 |
| JP | 53-125457 | | 10/1978 | |
| JP | 60-73778 | | 5/1985 | |
| JP | 09310553 | A * | 12/1997 | |
| JP | 2000337015 | A * | 12/2000 | |
| JP | 2012-092649 | | 5/2012 | |
| WO | WO 2010/097996 | | 9/2010 | |

OTHER PUBLICATIONS

International Search Report, PCT/JP2013/075519, Nov. 12, 2013.

* cited by examiner

*Primary Examiner* — Chuck Mah
(74) *Attorney, Agent, or Firm* — Young & Thompson

(57) ABSTRACT

Provided is a door opening and closing device that includes: a main opening and closing device body attached to a housing; a mounting member attached to a door; an arm pivotably provided to the main opening and closing device body, the arm applying force to the door via the mounting member in an opening direction and/or a closing direction; a slider provided to the main opening and closing device body to be slidable in one direction; an urging unit for urging the slider in the one direction; a transmission mechanism for transmitting urging force of the urging unit to the arm; and a door restraint link pivotably linked to the arm at a position away from the center of pivot of the arm, pivotably linked to the mounting member, and slidably linked to the main opening and closing device body so that the door moves in a certain manner.

17 Claims, 16 Drawing Sheets

SECTIONAL VIEW ALONG LINE V-V

PRIOR ART

DOOR OPENING AND CLOSING DEVICE

TECHNICAL FIELD

The present invention relates to a door opening and closing device for facilitating opening and closing of a door.

BACKGROUND ART

As a door opening and closing device for facilitating opening and closing of a door, the applicant has proposed a door opening and closing device illustrated in FIG. 16 (refer to Patent Literature 1). As illustrated in FIG. 16, a door 2 is connected to a housing 1 via hinges 3 to be pivotable about a horizontal axis. The closer the opening angle of the door 2 gets to 90 degrees, the greater the moment produced by own weight of the door 2 becomes, and this requires a greater force to open the door 2. The door opening and closing device 4 exerts a force for assisting opening and closing of the door 2 so as to facilitate manual operations of opening and closing of the door.

The door opening and closing device 4 includes a main opening and closing device body 5 attached to the housing 1 and an arm 6 pivotably provided to the main opening and closing device body 5. At a tip end of the arm 6, an arm slider 7 is provided to be slidable in a length direction of the arm 6. The arm slider 7 is pivotably linked to the door 2. Inside the main opening and closing device body 5, a slider crank mechanism (not shown) for exerting a force to assist opening and closing of the door 2 is provided. The force for assisting the opening and closing of the door 2 is transmitted to the arm 6 from the slider crank mechanism.

CITATION LIST

Patent Literature

Patent Literature 1: WO 2010/097996

SUMMARY OF INVENTION

Technical Problem

However, the conventional door opening and closing device requires the hinges 3 for restraining the door 2 so that the door 2 moves in a certain manner in addition to the door opening and closing device 4. It is necessary to mount both of the door opening and closing device 4 and the hinges 3 to the housing 1 and the door 2, which complicates a mounting operation.

Therefore, it is an object of the present invention to provide a door opening and closing device for applying a force in an opening direction and/or a closing direction to a door, which obviates the need for a hinge for restraining the door so that the door moves only in a certain manner.

Solution to Problem

In order to solve the above-described problem, the present invention provides a door opening and closing device comprising: a main opening and closing device body attached to a housing; a mounting member attached to a door; an arm pivotably provided to the main opening and closing device body, the arm applying force to the door via the mounting member in an opening direction and/or a closing direction; a slider provided to the main opening and closing device body so as to be slidable in one direction; an urging means for urging the slider in the one direction; a transmission mechanism for transmitting urging force of the urging means to the arm; and a door restraint link pivotably linked to the arm at a position away from the center of pivot of the arm, pivotably linked to the mounting member, and linked to the main opening and closing device body or the slider slidably or via an auxiliary link so that the door moves in a certain manner, wherein the door restraint link and the slider overlap each other when seen in an axial direction of a pivotal axis of the arm.

In a preferred embodiment of the present invention, a shaft is provided to the main opening and closing device body and elongated holes through which the shaft is inserted are formed in the slider and the door restraint link.

In a preferred embodiment of the present invention, a recessed portion is formed in a side face of the slider and the door restraint link is housed in the recessed portion of the slider.

In a preferred embodiment of the present invention, the urging means is one or more coil springs and a portion of the slider where the recessed portion is formed has a smaller width than an outer diameter of at least one of the coil springs when the slider is seen in a section orthogonal to the one direction.

In a preferred embodiment of the present invention, the door opening and closing device further includes an expanding and contracting damper in which a shaft portion moves in the one direction relative to a main body portion, wherein one of the main body portion and the shaft portion comes in contact with the arm and the other of the main body portion and the shaft portion comes in contact with the slider.

In a preferred embodiment of the present invention, the transmission mechanism is a cam provided to the slider and a roller for coming in contact with the cam is provided to the arm.

The door is a flap door which can pivot about a horizontal axis, the main opening and closing device body is attached to a side plate of the housing, and the mounting member is attached to a back face of the flap door.

Advantageous Effects of Invention

According to the present invention, because the door opening and closing device is provided with a door restraint link for restraining the door so that the door moves in the certain manner, it is possible to obviate the need for a hinge in addition to the door opening and closing device. Moreover, because the door restraint link is pivotably linked to the arm at the position away from the center of pivot of the arm, the door restraint link moves forward relative to the housing as the arm pivots when the door is opened. Therefore, it is possible to open the door while the door is brought ahead of the housing. By opening the door while the door is brought ahead of the housing, it is possible to prevent the door and the housing from interfering with each other. Furthermore, when seen in the axial direction of the pivotal axis of the arm, the door restraint link and the slider overlap each other, which increases a degree of flexibility in layout of the door restraint link and the slider. It is possible to prevent increase in size of the door opening and closing device, even though the door restraint link moves forward and backward while pivoting and the slider is increased in size for the purpose of obtaining greater urging force.

According to the preferred embodiment of the invention, a shaft is provided to the main opening and closing device body and therefore it is possible to prevent rattling of the shaft to thereby stabilize movement of the door restraint link guided by the shaft. Moreover, because an elongated hole through which the shaft is inserted is formed in the slider, it is possible to prevent increase in size of the door opening and closing device, even if the slider is increased in size for the purpose of obtaining the greater urging force.

According to the preferred embodiment of the invention, a recessed portion is formed in the side face of the slider and the door restraint link is housed in the recessed portion of the slider. Therefore, it is possible to prevent increase in size of the door opening and closing device in a thickness direction.

According to the preferred embodiment of the invention, the urging means is coil springs and the portion of the slider where the recessed portion is formed has a smaller width than an outer diameter of the coil spring when the slider is seen in a section orthogonal to the one direction. Therefore, the width of the slider can be small, even if the diameters of the coil springs are increased for the purpose of obtaining greater urging force.

According to the preferred embodiment of the invention, because an expanding and contracting damper, in which the shaft portion moves in the one direction relative to the main body portion, is provided between the arm and the slider, it is possible to contract the expanding and contracting damper by utilizing the pivoting of the arm and the sliding of the slider in the one direction. Therefore, it is possible to generate large damping force.

According to the preferred embodiment of the invention, because the transmission mechanism is a cam provided to the slider and a roller for coming in contact with the cam is provided to the arm, it is possible to stably transmit the urging force of the urging means to the arm.

According to the preferred embodiment of the invention, the door is a flap door which can pivot about a horizontal axis, the main opening and closing device body is attached to the side plate of the housing, and the mounting member is attached to the back face of the flap door. Therefore, it is possible to open the flap door, which pivots about the horizontal axis, with a slight force. Furthermore, it is possible to stop the flap door at an arbitrary position.

DESCRIPTION OF EMBODIMENTS

Figure 1:
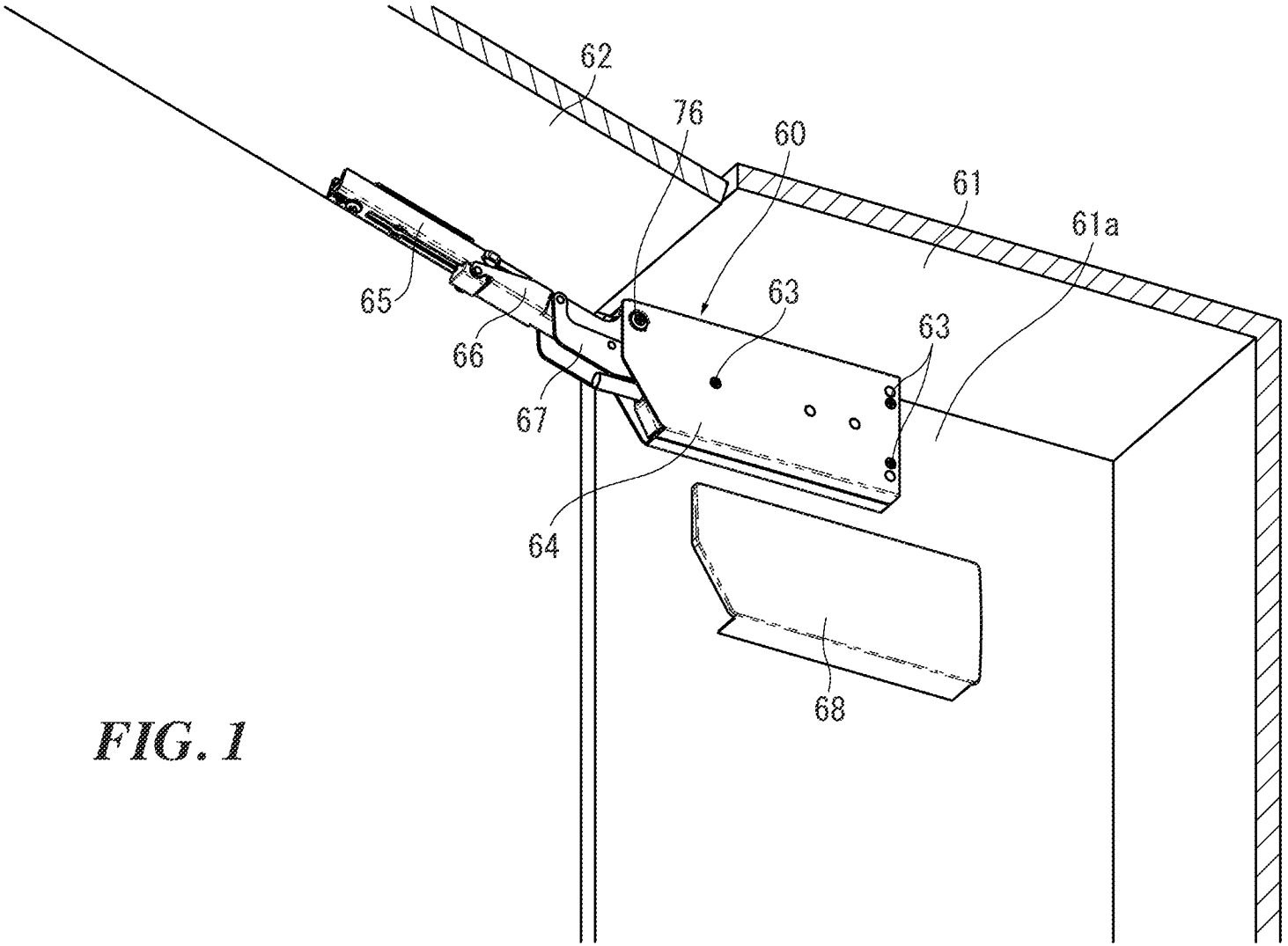
FIG. 1 illustrates a perspective view of a door opening and closing device according to a first embodiment of the present invention.

A door opening and closing device according to a first embodiment of the present invention will be described below in detail based on the accompanying drawings. FIG. 1 illustrates a perspective view of the door opening and closing device 60 attached to a housing 61 and a door 62. To an inner face of a side plate 61*a* of the housing 61, a case 64 as a main opening and closing device body is attached by fastening means such as screws 63. In order to stabilize opening and closing of the door 62, the door opening and closing device 60 is provided to the inner face of each of the left and right side plates 61*a* of the housing 61. The door 62 is a flap door which can pivot about a horizontal axis. A mounting member 65 is attached to a back face of the door 62.

Between the case 64 and the mounting member 65, arms 66 and door restraint links 67 are supported. The arms 66 exert a force for assisting opening and closing of the door 62 by manual operations. The door restraint links 67 restrain the door 62 so that the door 62 moves in a certain manner. Because the door 62 is restrained by the door restraint links 67, hinges for restraining the door 62 are not provided in addition to the door opening and closing devices 60. The case 64 is covered with a facing cover 68.

Figure 2:
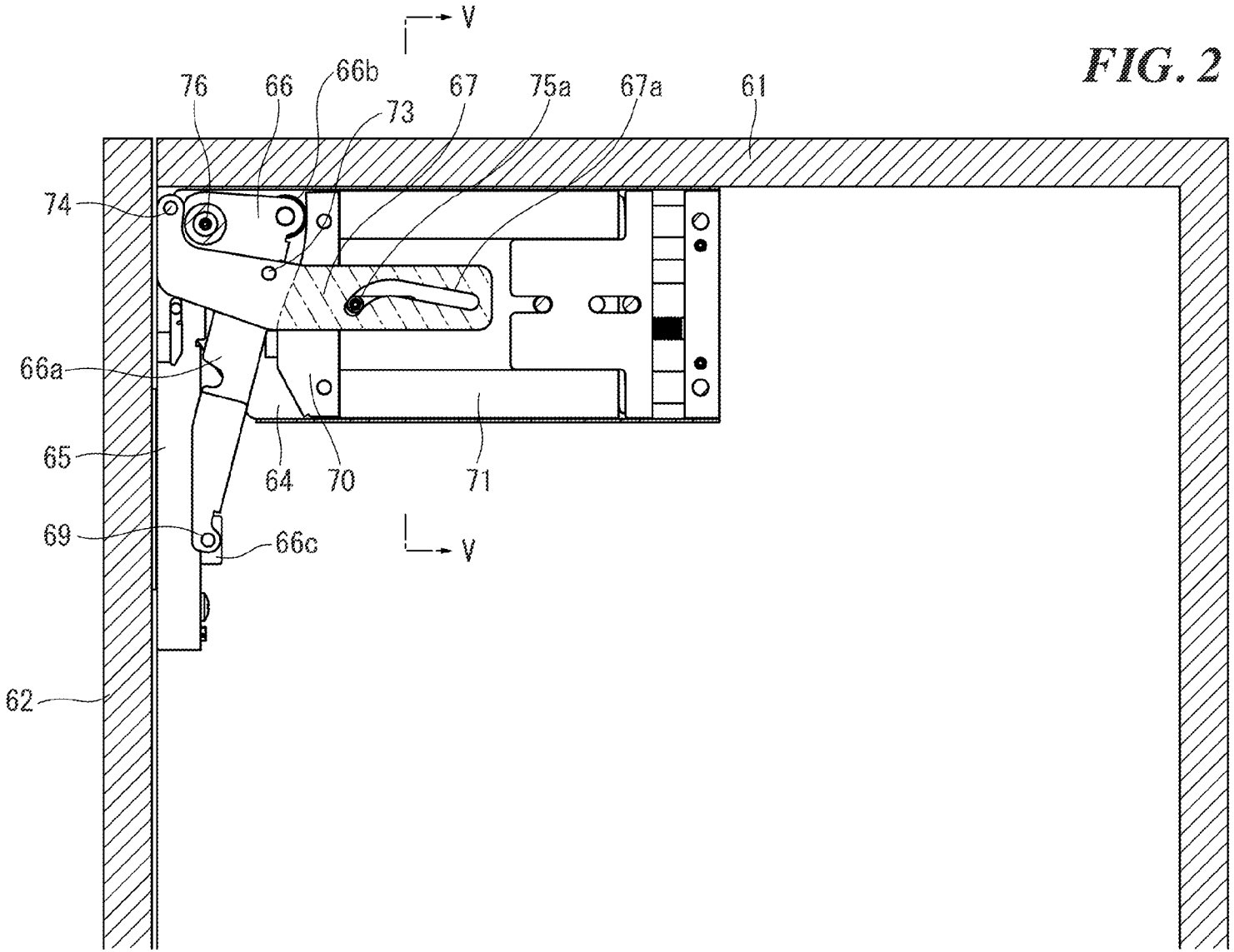
FIG. 2 illustrates a side view of the door opening and closing device according to the first embodiment.

FIG. 2 illustrates an inner structure of the door opening and closing device 60 in a closed state of the door 62. The arms 66 are provided to the case 64 to be pivotable about an arm shaft 76. The arms 66 include arm main bodies 66*a* formed in substantially L shapes and extending downward from the arm shaft 76 to be narrower, a roller 66*b* provided to corner portions of the L shapes, and an arm slider 66*c* provided to tip ends of the arm main bodies 66*a*.

Figure 3:
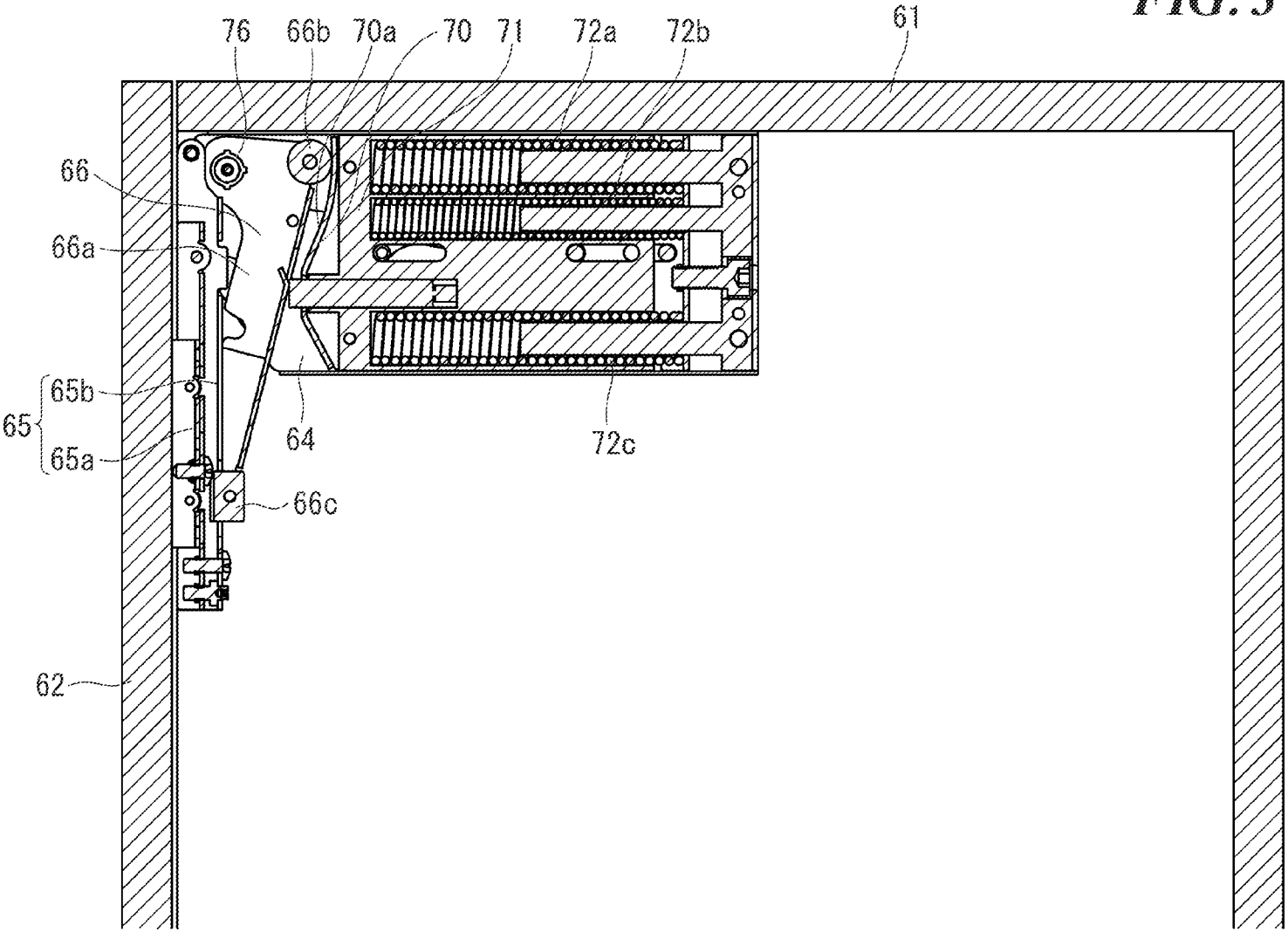
FIG. 3 illustrates a vertical sectional view (vertical sectional view parallel to a side plate of a housing) of the door opening and closing device according to the first embodiment.

As illustrated in a sectional view in FIG. 3, the roller 66*b* comes into a rolling contact with a cam 70 as a transmission mechanism. The cam 70 is provided to a slider 71 so as to carry out a linear motion with the slider 71. The slider 71 is urged in one direction by coil springs 72*a* to 72*c* as urging means. The coil springs 72*a* to 72*c* include large-diameter coil springs 72*a* and 72*c* and a small-diameter coil spring 72*b*. The cam 70 transmits urging forces of the coil springs 72*a* to 72*c* to the arms 66. On the cam 70, a mound-shaped cam face 70*a* is formed so as to switch a direction of torque to be applied to the arms 66.

The arm slider 66*c* can pivot about a shaft 69 relative to the arm main bodies 66*a* and slide in a vertical direction relative to the mounting member 65. As illustrated in FIG. 2, the door restraint links 67 are pivotably linked to the arm main bodies 66*a* via a shaft 73 at positions away from the arm shaft 76. One end portions of the door restraint links 67 are pivotably linked to the mounting member 65 via a shaft 74. The other end portions of the door restraint links 67 are pivotably and slidably linked to the case 64 via a shaft 75*a*.

With reference to an exploded perspective view in FIG. 4, structures of respective portions of the door opening and closing device 60 will be described below. The case 64 is formed by coupling two split case half bodies 64*a* and 64*b*. The case half bodies 64*a* and 64*b* are formed by bending thin plates. Between the case half bodies 64*a* and 64*b*, parts such as the slider 71 are sandwiched. The arm shaft 76 which serves as a pivotal axis of the arms 66 is fixed to the case 64. To the case 64, paired shafts 75*a* and 75*b* for guiding the slider 71 are fixed. To the case 64, a shaft 79 for guiding a spring bracket 78 is fixed. If the slider 71 is guided by inner faces of the case 64, the paired shafts 75*a* and 75*b* need not guide the slider 71. In this case, elongated holes 71*a* and 71*b* in the slider 71 only serve as relief holes for the shafts 75*a* and 75*b*.

The arms 66 include arm main bodies 66*a* formed in substantially L shapes and extending from the arm shaft 76 toward a mounting member main body 65*b* to be narrower, a roller 66*b* provided to the corner portions of the L shapes, and an arm slider 66*c* provided to the tip ends of the arm main bodies 66*a*. The arm main body 66*a* has two turning pairs. In other words, one end portions of the arm main bodies 66*a* are pivotably linked to the case 64 via the arm shaft 76. The other end portions of the arm main bodies 66*a* are pivotably linked to the arm slider 66*c* via the shaft 69. The arm slider 66*c* has a sliding pair and is slidably linked to the mounting member main body 65*b* so as to be slidable in one direction.

Each of the door restraint links 67 is formed in a substantially L shape on the whole. The door restraint link 67 has three turning pairs and one sliding pair. In other words, the one end portions of the door restraint links 67 are pivotably linked to the mounting member main body 65*b* via the shaft 74. Central portions of the door restraint links 67 are pivotably linked to the arm main bodies 66*a* via the shaft 73. In the other end portions of the door restraint link 67, substantially U-shaped elongated holes 67*a* are formed. The shaft 75*a* is inserted through the elongated holes 67*a*. The other end portions of the door restraint links 67 are slidably and pivotably linked to the case 64.

Figure 5:
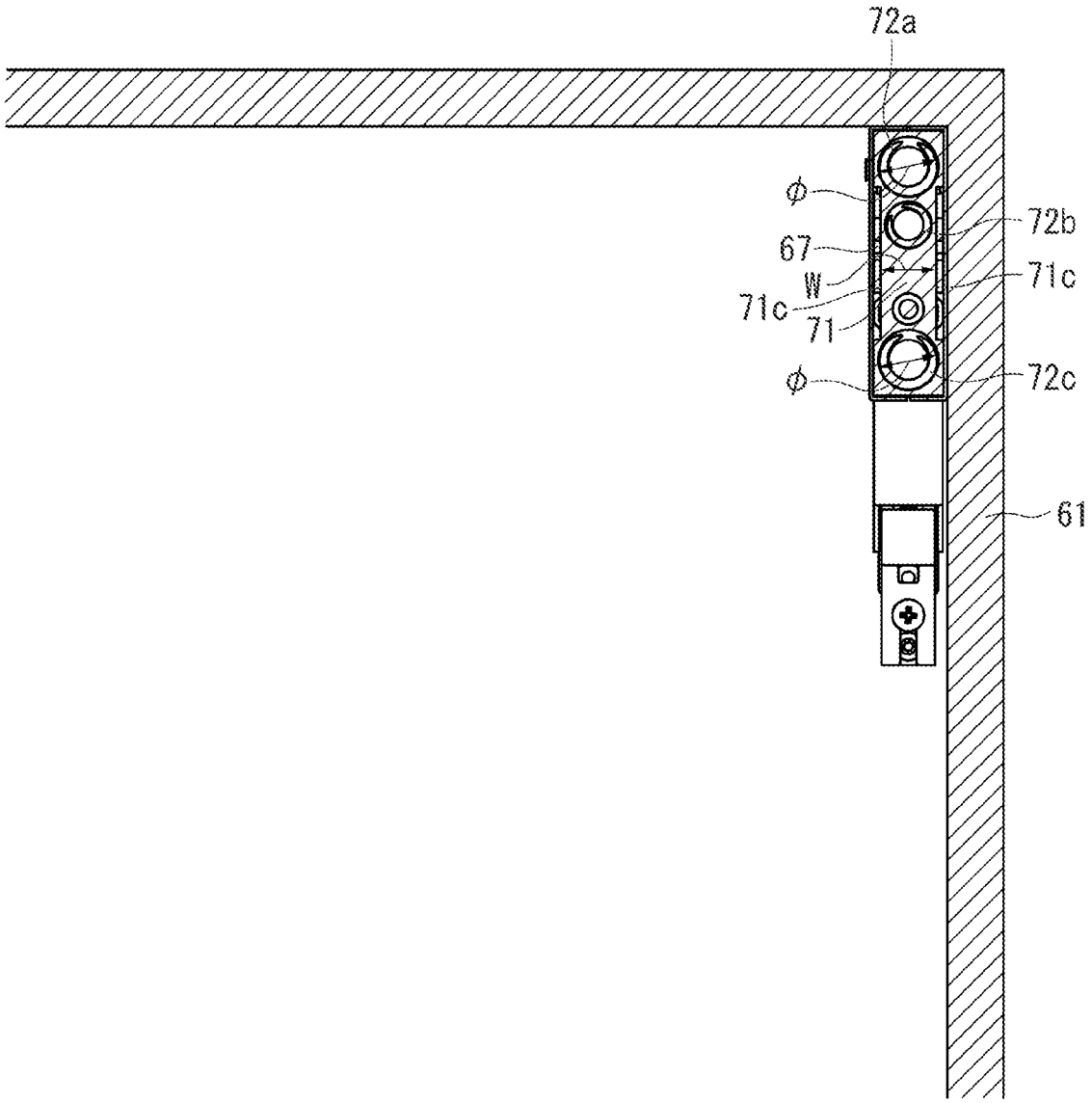
FIG. 5 illustrates a sectional view taken along line V-V in FIG. 2.

The slider 71 is provided to the case 64 to be movable in the one direction. The slider 71 is provided with the paired straight elongated holes 71*a* and 71*b* through which the paired shafts 75*a* and 75*b* fixed to the case 64 are inserted. The shaft 75*a* is inserted through the elongated hole 71*a* in the slider and the elongated holes 67*a* in the door restraint links 67. On side faces of the slider 71, recessed portions 71*c* are formed. The recessed portions 71*c* are formed by grooves extending in the one direction. In the recessed portions 71*c*, the door restraint links 67 are housed. The door restraint links 67 are sandwiched between the slider 71 and the case 64 (refer to FIG. 5). As illustrated in FIG. 5, when the slider 71 is seen in a section (vertical section) orthogonal to the one direction, a width W of a portion of the slider 71 where the recessed portions 71*c* are formed is smaller than outer diameters ϕ of the large-diameter coil springs 72*a* and 72*c* (described later).

Figure 4:
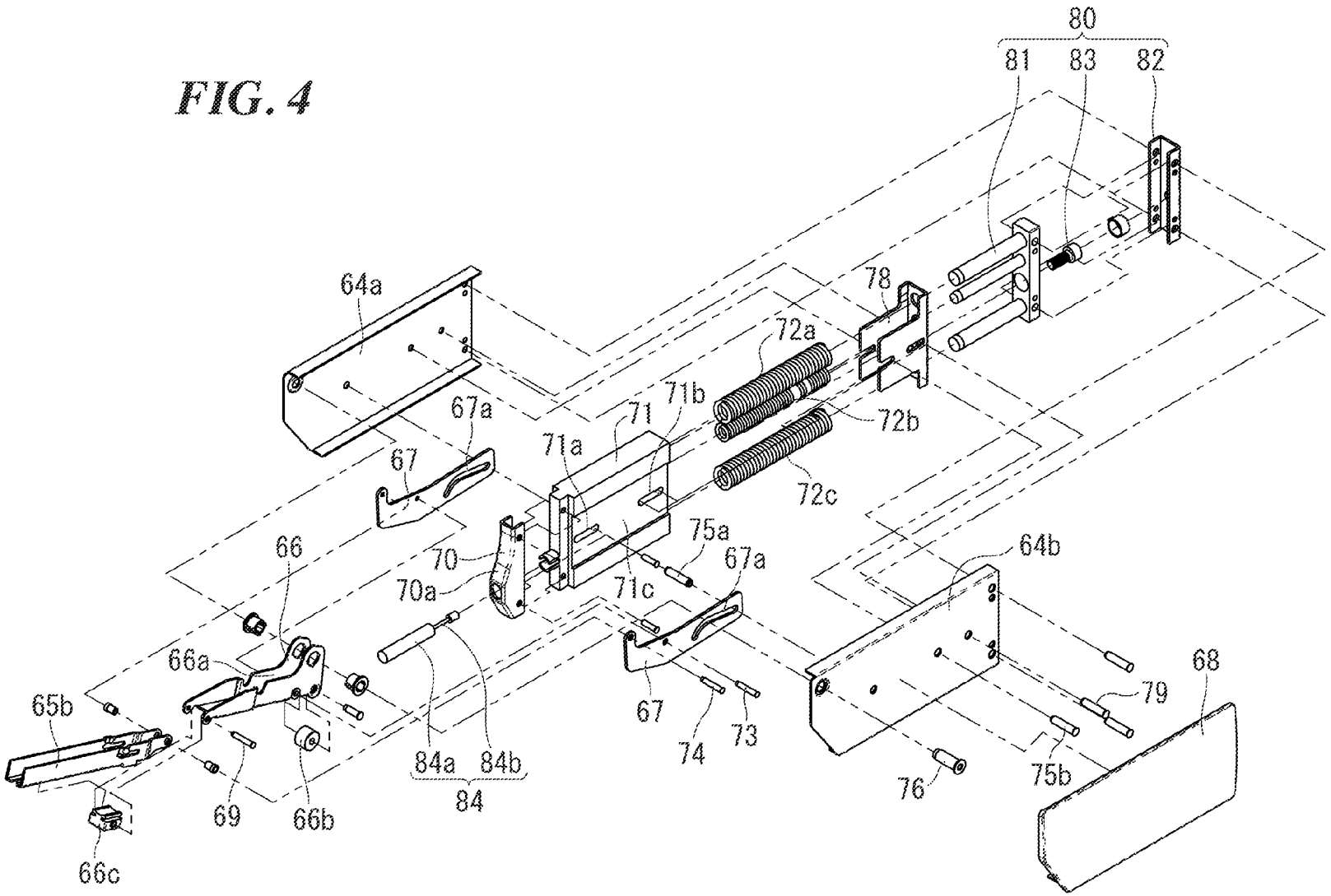
FIG. 4 illustrates an exploded perspective view of the door opening and closing device according to the first embodiment.

As illustrated in FIG. 4, in the slider 71, a plurality of coil springs 72*a* to 72*c* as urging means are housed. The coil springs 72*a* to 72*c* include large-diameter coil springs 72*a* and 72*c* and a small-diameter coil spring 72*b*. The coil springs 72*a* to 72*c* are compressed between the slider 71 and the spring bracket 78. In order to adjust the urging forces of the coil springs 72*a* to 72*c*, a position of the spring bracket 78 in the one direction can be adjusted by a position adjusting mechanism 80. The position adjusting mechanism 80 includes a spring inner diameter guide 81 fixed to the case 64 with a support plate 82 interposed therebetween and an adjusting screw 83 provided to the spring inner diameter guide 81. The adjusting screw 83 is screwed into the spring bracket 78. By turning the adjusting screw 83, it is possible to adjust the position of the spring bracket 78 in the one direction. To a front end portion of the slider 71, a cam 70 having a mound-shaped cam face 70*a* is attached. The cam face 70*a* comes in contact with the roller 66*b* of the arms 66.

In the front end portion of the slider 71, a damper 84 for exerting a damping force by use of viscous resistance of fluid is embedded. The damper 84 is an expanding and contracting damper including a cylindrical main body portion 84*a* and a shaft portion 84*b* which moves in one direction relative to the main body portion 84*a*. The moving direction of the shaft portion 84*b* is parallel to the one direction in which the slider 71 moves. One of the main body portion 84*a* and the shaft portion 84*b* comes in contact with the arms 66 and the other of the main body portion 84*a* and the shaft portion 84*b* is housed in a damper housing hole in the slider 71 to come in contact with the slider 71. The damper 84 is provided between the arms 66 and the slider 71. When the arms 66 pivot at a predetermined or greater angle in a closing direction, the arms 66 and the damper 84 come in contact with each other to compress the damper 84.

As illustrated in FIG. 3, the mounting member 65 includes a metal pedestal 65*a* attached to the door 62 by fastening means such as screws and a mounting member main body 65*b* attached to the metal pedestal 65*a* by fastening means such as screws. The metal pedestal 65*a* is attached to the door 62 in advance and then the mounting member main body 65*b* is attached to the metal pedestal 65*a*. By providing the metal pedestal 65*a*, it is possible to adjust a three-dimensional position of the door 62 in front-back, left-right, and vertical directions.

As illustrated in FIG. 2, when seen in a direction of the arm shaft 76 of the arms 66, the door restraint links 67 and the slider 71 overlap each other. In FIG. 2, the overlap is illustrated as an area hatched with one-dot-chain lines. If a plurality of coil springs 72*a* to 72*c* are provided or the coil springs 72*a* to 72*c* are increased in size for the purpose of increasing the urging forces of the coil springs 72*a* to 72*c*, the slider 71 is also increased in size. The door restraint links 67 are linked to the arms 66 via the shaft 73 and move forward and backward in a left-right direction in FIG. 2 while pivoting as the arms 66 pivot. If the door restraint links 67 and the slider 71 overlap each other, it increases a degree of freedom in layout of the door restraint links 67 and the slider 71 and prevents increase in size of the door opening and closing device 60, even though the door restraint links 67 move forward and backward while pivoting and the slider 71 is increased in size.

The door restraint links 67 cause the door 62 to move in the certain manner on the following principle. As illustrated in FIG. 2, the central portions in the length direction of the door restraint links 67 are pivotably linked to the arms 66 via the shaft 73. The one end portions of the door restraint links 67 are pivotably linked to the mounting member 65 via the shaft 74. In the other end portions of the door restraint links 67, elongated holes 67*a* are formed. Through the elongated holes 67*a*, a shaft 75*a* fixed to the case 64 is slidably and pivotably inserted.

On the other hand, the one end portions of the arms 66 are pivotably linked to the arm shaft 76 of the case 64. The other end portions of the arms 66 are pivotably and slidably linked to the mounting member 65 via the shaft 69.

Figure 6:
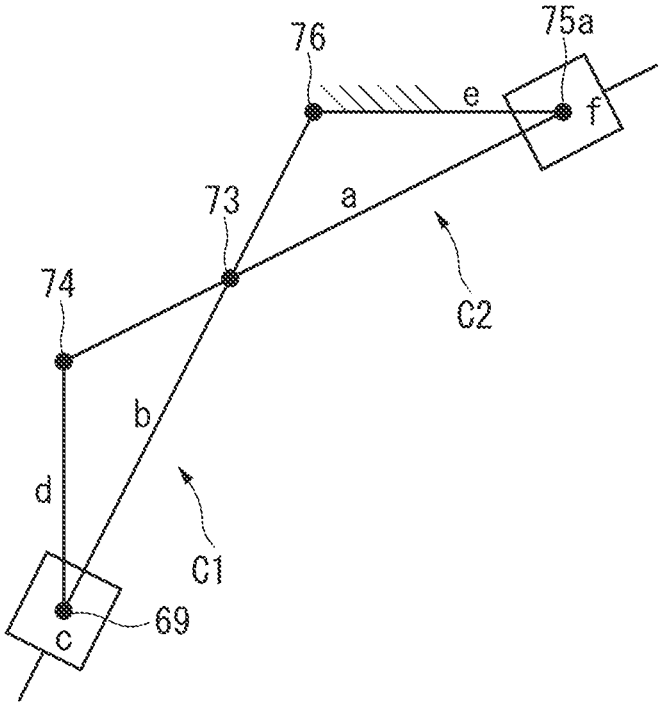
FIG. 6 illustrates a schematic view of a mechanism of the door opening and closing device according to the first embodiment.
Figure 7B:
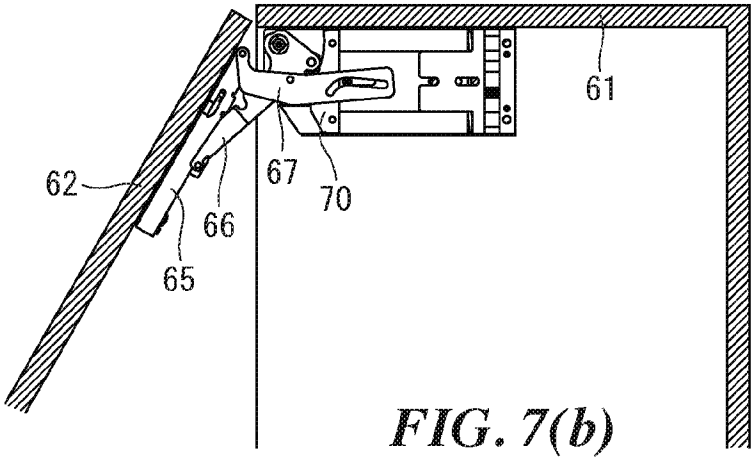
FIGS. 7(*a*) to 7(*d*) illustrate motion diagrams of the door opening and closing device according to the first embodiment (FIG. 7(*a*) illustrates a fully-closed state of a door, FIG. 7(*b*) illustrates a state in which the door is open about 30 degrees, FIG. 7(*c*) illustrates a state in which the door is open about 60 degrees, and FIG. 7(*d*) illustrates a fully-open state of the door).
Figure 7D:
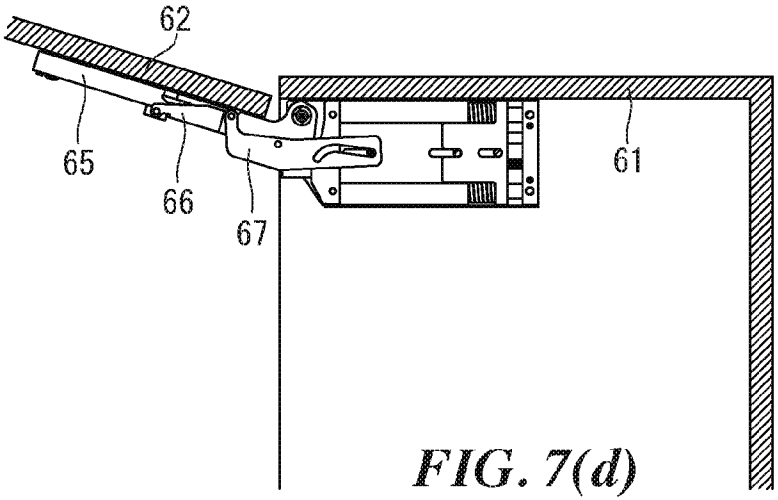
Figure 7A:
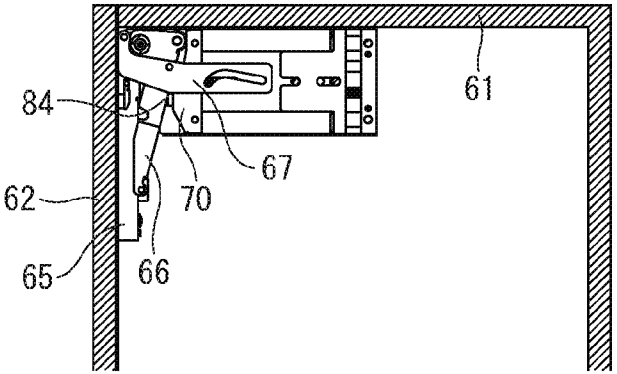
Figure 7C:
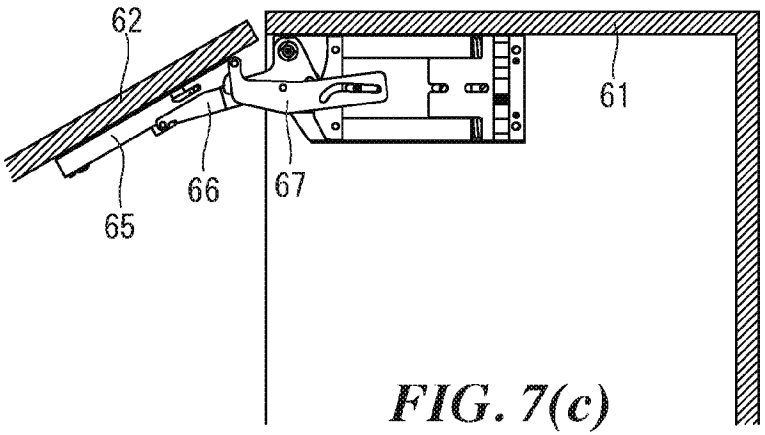

The arms 66 and the door restraint links 67 cross each other in X shapes to form an X linkage. As illustrated in FIG. 6, the X linkage can be considered to be a combination of two chains C1 and C2. As is clear from the comparison between FIGS. 2 and 6, the door restraint links 67 correspond to a link a, the arms 66 correspond to a link b, the arm slider 66*c* corresponds to a link c, and the mounting member 65 corresponds to a link d. The case 64 corresponds to a link e and the elongated holes 67*a* in the door restraint links 67 correspond to a link f. As can be seen from this skeleton diagram, if the link e is fixed, the link d can move only in a certain manner. By providing the door restraint links 67, the door 62 can move only in the certain manner.

FIGS. 7(*a*) to 7(*d*) illustrate motion diagrams of the door opening and closing device 60. As illustrated in FIG. 7(*a*), in a closed state of the door 62, the cam 70 further applies a force in a closing direction to the door 62. Therefore, the door 62 is kept in the closed state.

As illustrated in FIG. 7(*b*), when the door 62 is opened a predetermined angle (e.g., about 30 degrees), a direction of the force applied from the cam 70 to the door 62 is switched and the force in an opening direction is applied to the door 62. From a state illustrated in FIG. 7(*b*) to a fully-open state illustrated in FIG. 7(*d*), it is possible to open the door 62 with a slight force. Moreover, between the state illustrated in FIG. 7(*b*) and the fully-open state illustrated in FIG. 7(*d*), it is possible to stop the door 62 at an arbitrary position. As illustrated in FIG. 7(*d*), in the open state of the door 62, the cam 70 further applies a force in the opening direction to the door 62. Therefore, the door 62 is kept in the open state.

As illustrated in FIGS. 7(*a*) to 7(*d*), as an opening angle of the door 62 increases, the arms 66 pivot in a clockwise direction. As the arms 66 pivot in the clockwise direction, the door restraint links 67 move forward relative to the housing 61. In this way, it is possible to open the door 62 while the door 62 is brought ahead of the housing 61.

In closing the fully-open door 62 illustrated in FIG. 7(*d*), when the door 62 is closed to the state illustrated in FIG. 7(*b*), a force in a closing direction is applied to the door 62. Therefore, even if a hand is removed from the door 62, the door 62 is automatically brought into a fully-closed state illustrated in FIG. 7(*a*). When the door 62 comes into the fully-closed state, the damper 84 is compressed between the arms 66 and the slider 71. Therefore, a damping force is generated to cause the door 62 to close slowly.

The door opening and closing device 60 according to the first embodiment exerts the following effects. Because the door restraint links 67 for restraining the door 62 so that the door 62 moves in the certain manner are provided, it is unnecessary to provide hinges in addition to the door opening and closing devices 60. Moreover, because the door restraint links 67 are pivotably linked to the arms 66 at the positions away from the centers of pivot of the arms 66, the door restraint links 67 move forward relative to the housing 61 as the arms 66 pivot when the door 62 opens. Therefore, it is possible to open the door 62 while the door 62 is brought ahead of the housing 61. By opening the door 62 while the door 62 is brought ahead of the housing 61, it is possible to prevent the door 62 and the housing 61 from interfering with each other. Furthermore, when seen in the axial direction of the arm shaft 76, the door restraint links 67 and the slider 71 overlap each other, which increases a degree of flexibility in layout of the door restraint links 67 and the slider 71 and prevents increase in size of the door opening and closing device 60, even though the door restraint links 67 move forward and backward while pivoting and the slider 71 is increased in size for the purpose of obtaining greater urging force.

Because the shaft 75*a* is provided to the case 64 and the elongated holes 71*a* and 67*a* through which the shaft 75*a* is inserted are formed in the slider 71 and the door restraint links 67, the same shaft 75*a* can perform both the functions of guiding the slider 71 and guiding the door restraint links 67. If the case 64 guides sliding of the slider 71 in the one direction, the increase in urging force of the urging means may cause deformation of the case 64. Because the direction of the torque applied to the arms 66 from the cam 70 reverses, the slider 71 pushes the case 64 upward and downward. By using the shaft 75*a* to guide sliding of the slider 71 in the one direction as in the embodiment, it is possible to prevent deformation of the case 64.

Because the recessed portions 71*c* are formed in the side faces of the slider 71 and the door restraint links 67 are housed in the recessed portions 71*c* of the slider 71, it is possible to prevent increase in size of the door opening and closing device 60 in a thickness direction (left-right direction in FIG. 5) as illustrated in FIG. 5.

Because the expanding and contracting damper 84 in which the shaft portion 84*b* slides in an axial direction relative to the main body portion 84*a* is provided between the arms 66 and the slider 71, it is possible to contract the expanding and contracting damper 84 by utilizing pivoting of the arms 66 and sliding of the slider 71 in the one direction. As a result, it is possible to generate large damping force.

The cam 70 provided to the slider 71 is employed as a transmission mechanism and the roller 66*b* for coming in contact with the cam 70 is provided to the arms 66. Therefore, it is possible to stably transmit the urging force of the coil springs 72*a* to 72*c* to the arms 66.

The door 62 is a flap door 62 which can pivot about a horizontal axis, the case 64 is attached to the inner face of the side plate 61*a* of the housing 61, and the mounting member 65 is attached to the back face of the flap door 62. Therefore, it is possible to open the flap door 62, which pivots about the horizontal axis, with a slight force (an assist function) and it is possible to stop the flap door 62, which has been opened a predetermined angle, at an arbitrary position (a free stop function).

Figure 8:
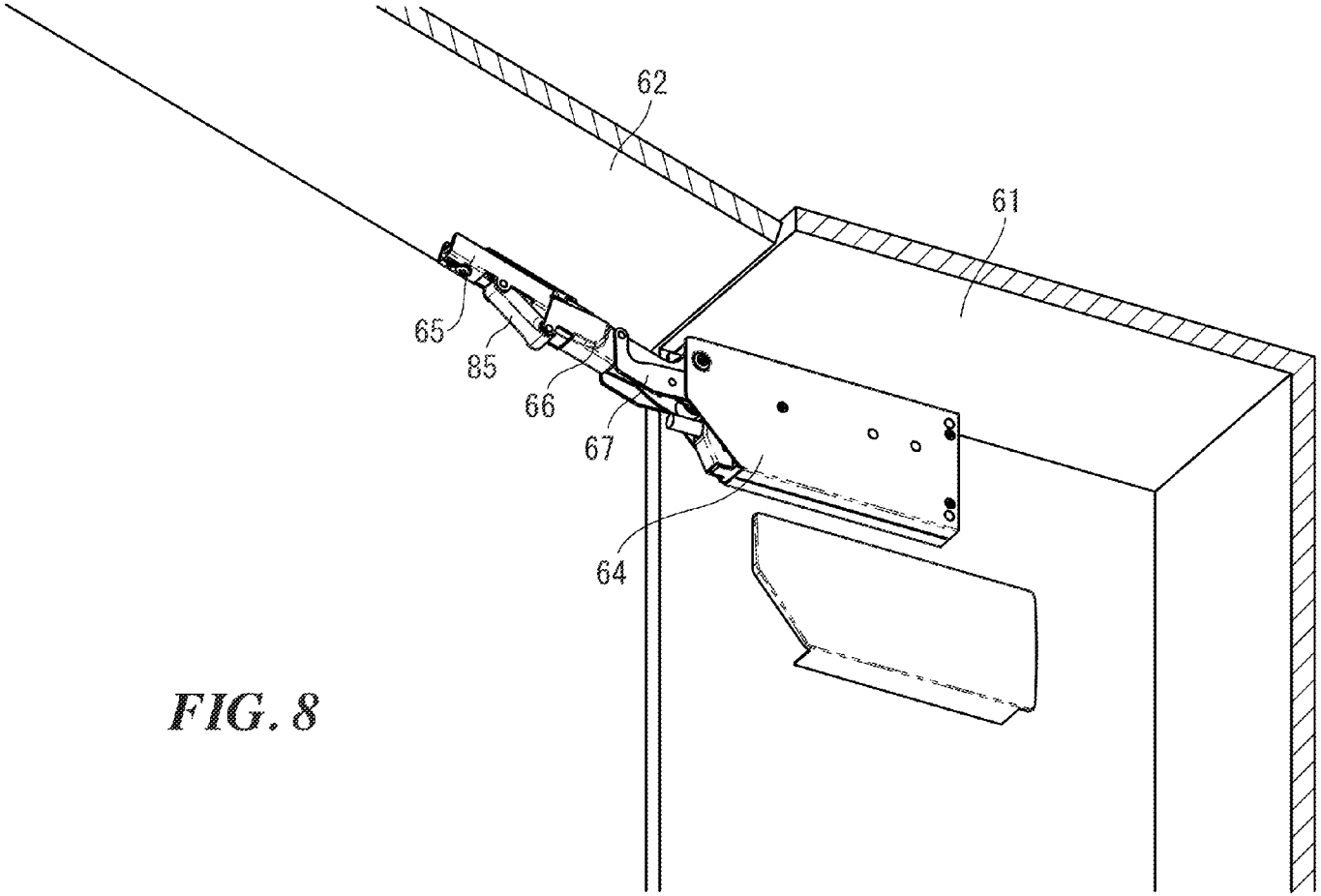
FIG. 8 illustrates a perspective view of a door opening and closing device according to a second embodiment of the invention.
Figure 9:
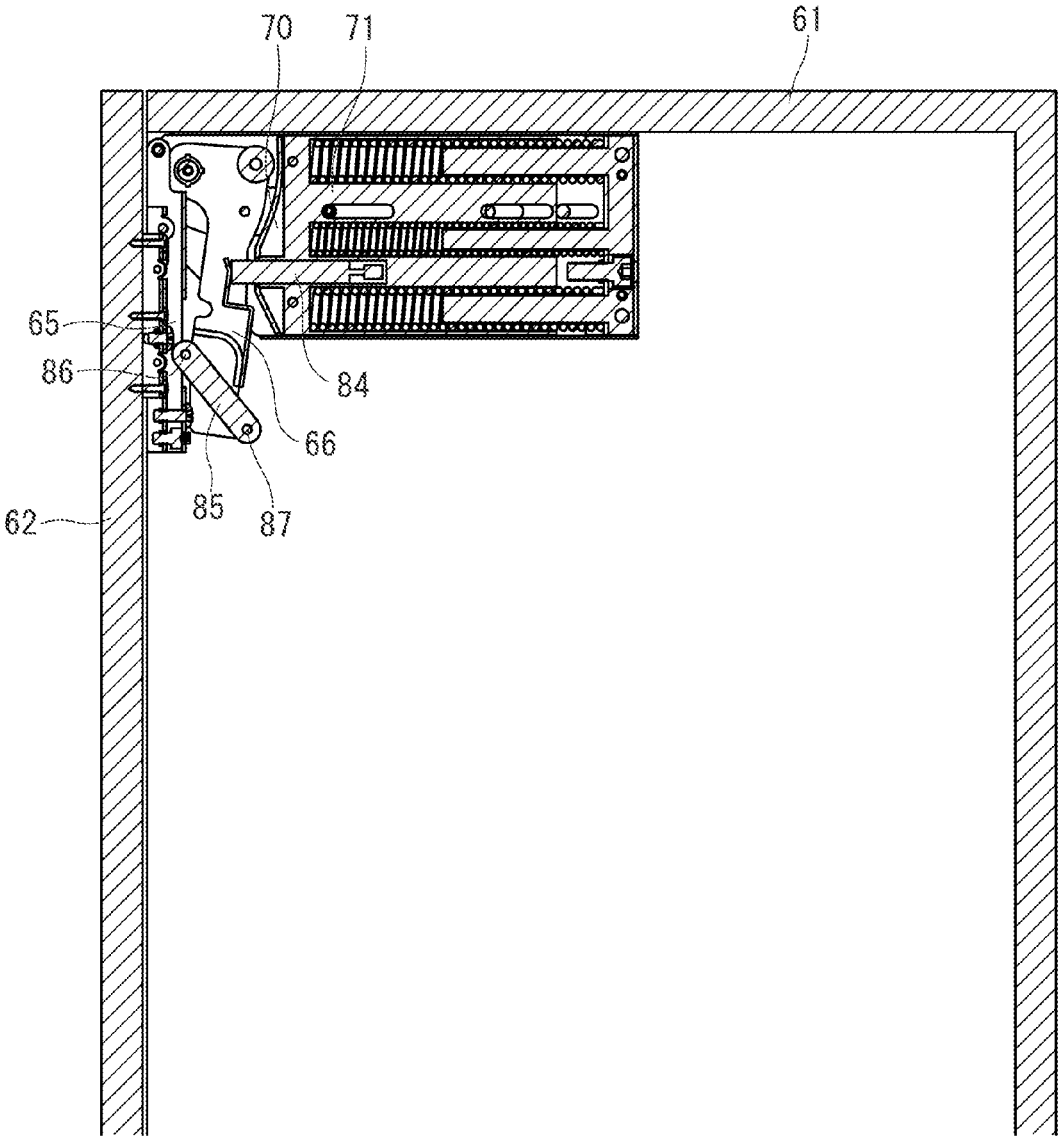
FIG. 9 illustrates a vertical sectional view (vertical sectional view parallel to a side plate of a housing) of the door opening and closing device according to the second embodiment.

FIGS. 8 and 9 illustrate a door opening and closing device according to a second embodiment of the invention. While the arms 66 are slidably linked to the mounting member 65 in the first embodiment, the second embodiment is different from the first embodiment in that the arms 66 are linked to the mounting member 65 via an auxiliary link 85 as illustrated in FIG. 8. Because the other structures are the same as those of the door opening and closing device according to the first embodiment, they will be provided with the same reference signs and will not be described.

As illustrated in FIG. 9, one end portion of the auxiliary link 85 is pivotably linked to the mounting member 65 via a shaft 86. The other end portion of the auxiliary link 85 is pivotably linked to the arms 66 via a shaft 87. If the arms 66 are linked to the mounting member 65 via the auxiliary link 85 as in the second embodiment, the door restraint links 67 cause a door 62 to move in a certain manner.

Figure 10:
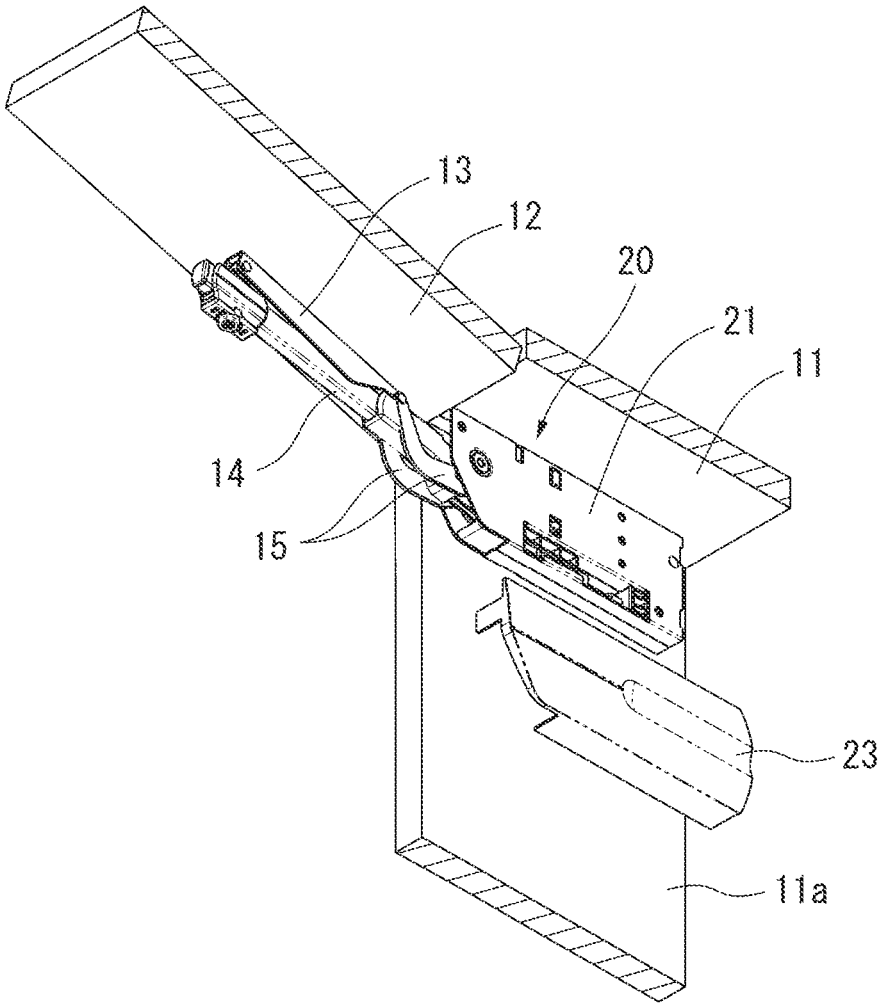
FIG. 10 illustrates a perspective view of a door opening and closing device according to a third embodiment of the invention.
Figure 11:
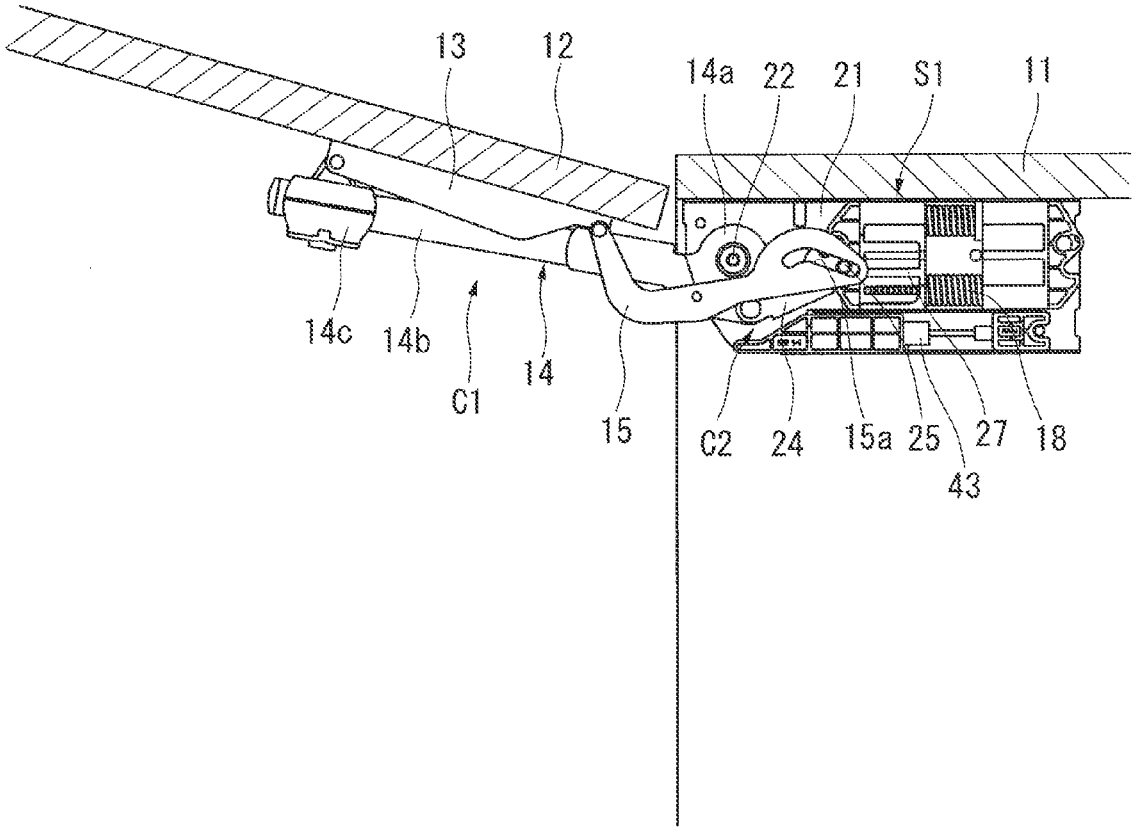
FIG. 11 illustrates a side view of the door opening and closing device according to the third embodiment.

FIGS. 10 to 13(*c*) illustrate a door opening and closing device according to a third embodiment of the invention. The door opening and closing device according to the third embodiment is different from the door opening and closing device according to the first embodiment mainly on the following three points. First, as illustrated in FIG. 11, while the cam 70 as a transmission mechanism is provided to the slider 71 in the first embodiment, force applying links 24 are pivotably linked to an arm 14 and a slider 27 and the force applying links 24 apply urging forces to the arm 14 in the third embodiment. Secondly, while the door restraint links 67 are slidably linked to the case 64 in the first embodiment, door restraint links 15 are slidably linked to the slider 27 in the third embodiment. Thirdly, while the damper 84 is provided between the slider 71 and the arms 66 in the first embodiment, a damper 43 is provided between a case 21 and the arm 14 in the third embodiment. The door opening and closing device according to the third embodiment will be described below in detail.

FIG. 10 illustrates a perspective view of a door opening and closing device 20 attached to a housing and a door. To an inner face 11*a* of the housing 11, a case 21 as a main opening and closing device body is attached by fastening means such as screws. In order to stabilize opening and closing of the door 12, the case 21 is provided to each of left and right side faces of the housing 11. To an inner face of the door 12, a mounting member 13 is attached by fastening means such as screws. The mounting member 13 extends in one direction along a surface of the door 12. Between the case 21 and the mounting member 13, an arm 14 and door restraint links 15 are supported. The arm 14 exerts a force for assisting opening and closing of the door 12 by manual operations. The door restraint links 15 restrain the door 12 so that the door 12 moves in a certain manner. Because the door 12 is restrained by the door restraint links 15, hinges for restraining the door 12 are not provided in addition to the door opening and closing devices 20. The case 21 is covered with a facing cover 23.

FIG. 11 illustrates an inner structure of the door opening and closing device 20. The arm 14 is pivotably provided to the case 21. The center of pivot of the arm 14 is an arm shaft 22 provided to the case 21. The arm 14 includes connecting plates 14*a* around the arm shaft 22, an arm main body 14*b* extending from the arm shaft 22 to the mounting member 13, and an arm slider 14*c* provided to the arm main body 14*b* to be slidable in a longitudinal direction. The arm slider 14*c* is pivotably linked to one end of the mounting member 13. The arm slider 14*c* is provided with a friction adjusting plate 31 (refer to FIG. 12) for adjusting the friction between the arm slider 14*c* and the arm main body 14*b*. The friction between the arm slider 14*c* and the arm main body 14*b* is adjusted so as to enable what is called free stop.

The door restraint links 15 and the force applying links 24 are pivotably linked to the connecting plates 14*a* of the arm 14 at positions away from the arm shaft 22. As described above, the door restraint links 15 are links for causing the door 12 to move in the certain manner. On the other hand, the force applying links 24 are links for applying forces in an opening direction and a closing direction to the door 12.

As illustrated in FIG. 11, a slider 27 is provided to the case 21 to be slidable in one direction. The slider 27 is urged in the one direction by coil springs 18 as urging means. Between the slider 27 and the arm 14, force applying links 24 are supported. One end portions of the force applying links 24 are pivotably linked to the arm 14. The other end portions of the force applying links 24 are pivotably linked to the slider 27 via a slider pivoting shaft 25. The urging forces of the coil springs 18 are converted into torque of the arm 14.

Figure 12:
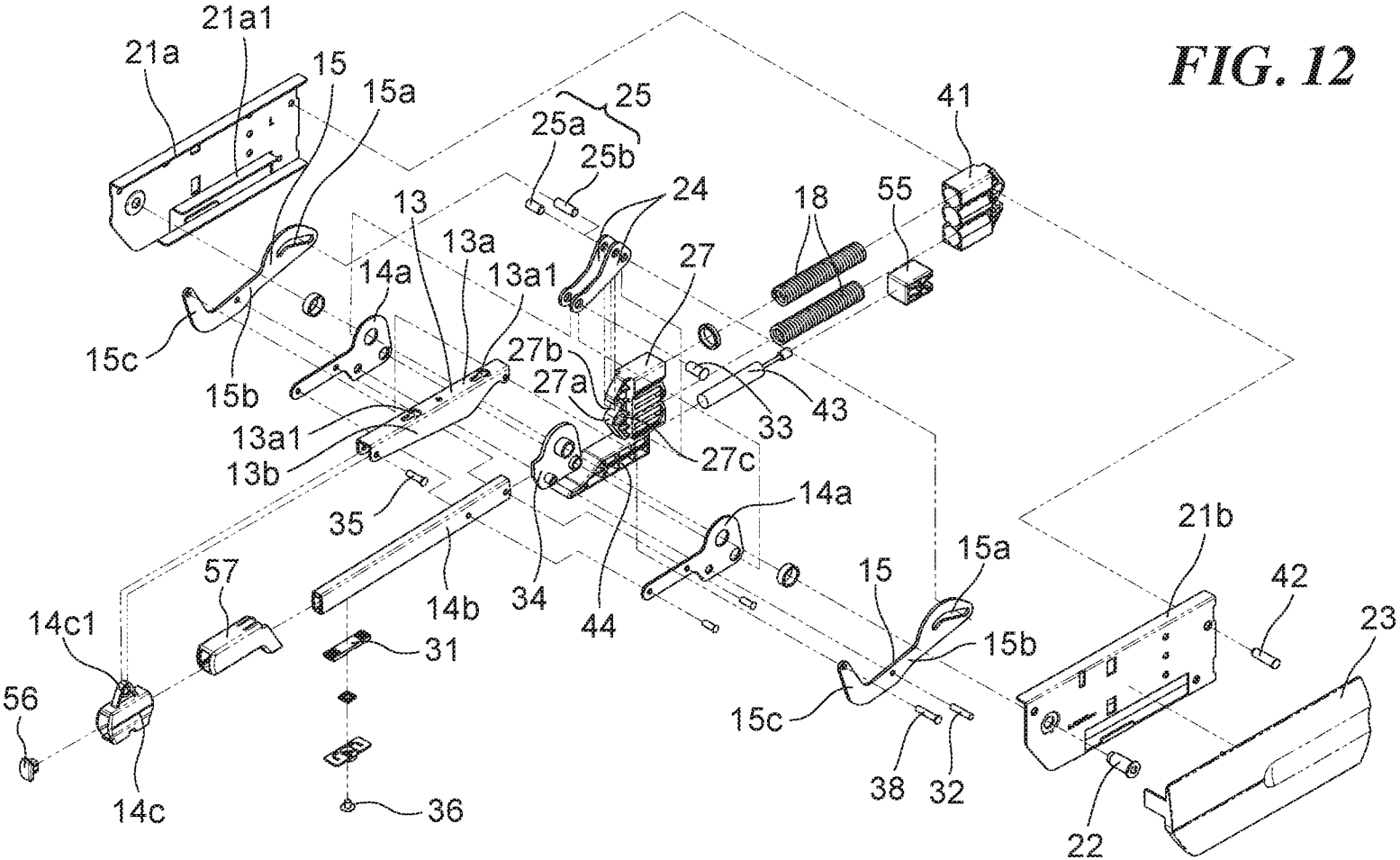
FIG. 12 illustrates an exploded perspective view of the door opening and closing device according to the third embodiment.

With reference to an exploded perspective view in FIG. 12, structures of the respective portions of the door opening and closing device 20 will be described below. The case 21 is formed by coupling two split case half bodies 21*a* and 21*b*. The case half bodies 21*a* and 21*b* are formed by bending thin plates. On each of the case half bodies 21*a* and 21*b*, a guide wall 21*a*1 protruding inward is formed. In the guide walls 21*a*1, the substantially rectangular slider 27 is housed to be slidable in the one direction along the guide walls 21*a*1. Between the case half bodies 21*a* and 21*b*, an arm shaft 22 which serves as a center of pivot of the arm 14 relative to the case 21 is provided. The case 21 is covered with a facing cover 23.

The arm 14 includes paired connecting plates 14*a* around the arm shaft 22 (hereafter referred to as a first shaft 22), an arm main body 14*b* extending from the first shaft 22 toward the mounting member 13, and an arm slider 14*c* provided to the arm main body 14*b* to be slidable in the longitudinal direction. Between the paired connecting plates 14*a*, a shaft insertion plate 34 is provided. Through the shaft insertion plate 34, the first shaft 22, a second shaft 32 which is a pivotal axis of the door restraint links 15 relative to the arm 14, and a third shaft 33 which is a pivotal axis of the force applying links 24 relative to the arm 14 are inserted. In one end portion of the arm main body 14*b*, mounting holes for attaching the paired connecting plates 14*a* are formed. Into the one end portion of the arm main body 14*b*, the connecting plates 14*a* are inserted. The connecting plates 14*a* and the arm main body 14*b* are linked by pins. The one end portion of the arm main body 14*b* is surrounded with a frame-shaped fixing piece. The tip end of the arm main body 14*b* is closed with a plug.

The arm main body 14*b* is provided with an arm slider 14*c* to be slidable in a length direction of the arm main body 14*b*. The arm slider 14*c* is formed in a frame shape surrounding the arm main body 14*b*. On the arm slider 14*c*, a protruding portion 14*c*1 linked to the mounting member 13 is formed. To the protruding portion 14*c*1 of the arm main body 14*b*, the mounting member 13 is pivotably attached via a fourth shaft 35.

Between the arm main body 14*b* and the arm slider 14*c*, a friction adjusting plate 31 is provided. The friction adjusting plate 31 slides with the arm slider 14*c*. A force of the friction adjusting plate 31 for pushing the arm main body 14*b* is adjusted by a position adjusting screw 36. By adjusting pressure of the friction adjusting plate 31, it is possible to adjust the resistance in sliding of the arm slider 14*c* relative to the arm main body 14*b*.

The mounting member 13 is formed into a U shape in cross-section and extends to be narrower in one direction. In a bottom wall 13*a* of the mounting member 13, screw holes 13*a*1 through which the screws for attaching the mounting member 13 to the surface of the door 12 are formed. To one end portion in a length direction of the mounting member 13, the arm slider 14*c* is pivotably linked. To the other end portion in the length direction of the mounting member 13, the door restraint links 15 are pivotably linked. Through side faces 13*b* of the mounting member 13, the fourth shaft 35 which is a pivotal axis of the arm slider 14*c* relative to the mounting member 13 and a fifth shaft 38 which is a pivotal axis of the door restraint links 15 relative to the mounting member 13 are inserted.

Each of the door restraint links 15 has a base portion 15*b* extending to be narrower in one direction and a tip end portion

15*c* bent relative to the base portion 15*b*, and the entire door restraint link 15 is formed into an L shape. Through a central portion in a length direction of the base portion 15*b*, the second shaft 32 is inserted. An outside shape of the base portion 15*b* is widened. Through elongated holes 15*a* in the base portions 15*b*, the slider pivoting shaft 25 (hereafter referred to as the sixth shaft 25) which is a pivotal axis of the force applying links 24 relative to the slider 27 is inserted. Through the tip end portions 15*c* of the door restraint links 15, the fifth shaft 38 is inserted. When seen in an axial direction of the arm shaft 22, the door restraint links 15 and the slider 27 overlap each other (refer to FIG. 11).

The paired force applying links 24 extend to be narrower in one direction. One end portions of the force applying links 24 are pivotably linked to the connecting plates 14*a* via the third shaft 33. The other end portions of the force applying links 24 are pivotably linked to the slider 27 via the sixth shaft 25. The sixth shaft 25 (the slider pivoting shaft 25) is formed by a first slider pivoting shaft 25*a* and a second slider pivoting shaft 25*b*.

The slider 27 is provided to the case 21 to be movable in the one direction. A spring bracket 41 is attached to the case 21 via a pin 42. Between the slider 27 and the spring bracket 41, coil springs 18 are provided. The slider 27 is urged in the one direction by the coil springs 18. At one end of the slider 27, a mound-shaped protrusion 27*a* is formed. The protrusion 27*a* is provided with a recessed portion 27*b* and an elongated hole 27*c* corresponding to the first slider pivoting shaft 25*a* and the second slider pivoting shaft 25*b* of the force applying links 24. The first slider pivoting shaft 25*a* is inserted through the recessed portion 27*b* and the second slider pivoting shaft 25*b* is fitted into the elongated hole 27*c*.

In the case 21, the damper 43 for generating a damping force by use of viscous resistance of fluid is attached. When the arm 14 pivots at a predetermined or greater angle in one direction, the arm 14 and a movable portion 44 of the damper 43 come in contact with each other to compress the damper 43. When the damper 43 is compressed, the damper 43 applies a damping force to the arm 14.

In this embodiment, the slider pivoting shaft 25 which serves as a center of pivot of the force applying links 24 relative to the slider 27 is formed by the first and second slider pivoting shafts 25*a* and 25*b*. When an opening angle of the door 12 is a predetermined or smaller angle, a switch from the first slider pivoting shaft 25*a* to the second slider pivoting shaft 25*b* is made to moderate the force acting on the door 12 in the closing direction. The switch from the first slider pivoting shaft 25*a* to the second slider pivoting shaft 25*b* will be described below.

Figure 13A:
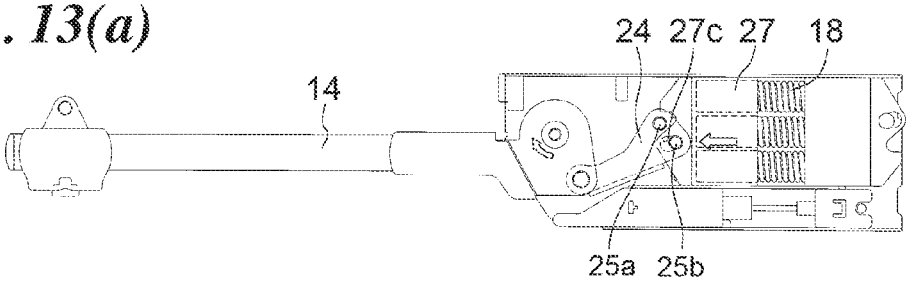
FIGS. 13(*a*) to 13(*c*) illustrate motion diagrams of a slider crank mechanism of the door opening and closing device according to the third embodiment (FIG. 13(*a*) illustrates an open state of a door, FIG. 13(*b*) illustrates a state in which the slider crank mechanism has reached a dead center, and FIG. 13(*c*) illustrates a closed state of the door).
Figure 13B:
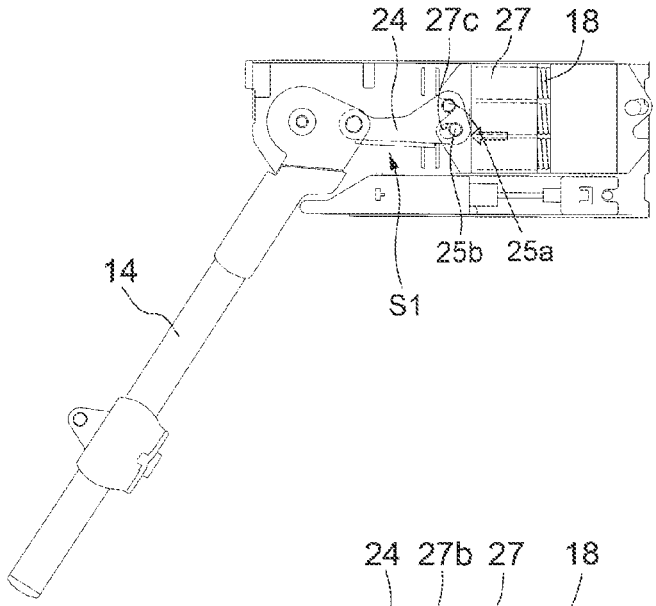
Figure 13C:
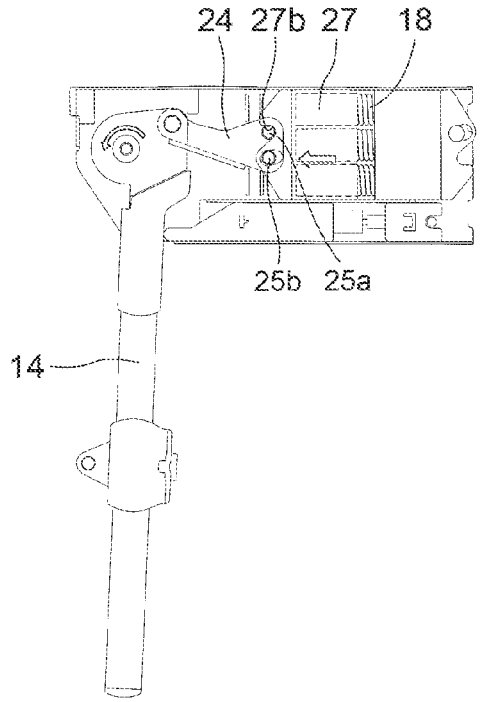

As shown in FIG. 13(*a*), in an open state of the door 12, the second slider pivoting shaft 25*b* of the force applying links 24 is positioned at a right end of the elongated hole 27*c* in the slider 27. In this state, the center of pivot of the force applying links 24 relative to the slider 27 is the second slider pivoting shaft 25*b*. The urging forces of the coil springs 18 are transmitted to the arm 14 via the second slider pivoting shaft 25*b* and the force applying links 24. In the open state of the door 12, torque in an opening direction acts on the arm 14.

As illustrated in FIG. 13(*b*), when the door 12 is turned in the closing direction, a slider crank mechanism S1 reaches a dead center. As shown in FIG. 13(*c*), when the door 12 is further turned in the closing direction, the slider crank mechanism S1 passes over the dead center and torque in the closing direction acts on the arm 14.

In the door opening and closing device 20 with the door 12 pivoting about a horizontal axis, the moment acting on the door 12 increases as the door 12 opens an angle close to 90 degrees. The slider crank mechanism S1 is utilized to facilitate manual operations of opening the door 12. If the urging forces of the coil springs 18 are increased, the opening operations of the door 12 become easier. However, if the urging forces of the coil springs 18 are increased, the opening of the closed door 12 becomes heavy. In order to avoid this, as illustrated in FIGS. 13(*b*) and 13(*c*), the center of pivot of the force applying links 24 relative to the slider 27 is switched from the second slider pivoting shaft 25*b* to the first slider pivoting shaft 25*a*. As illustrated in FIG. 13(*c*), when the force applying links 24 pivot, the second slider pivoting shaft 25*b* rises from the state in which it is seated in the right end of the elongated hole 27*c* in the slider 27, and the first slider pivoting shaft 25*a* gets seated in the recessed portion 27*b* of the slider 27 in place of the second slider pivoting shaft 25*b*.

Figure 14:
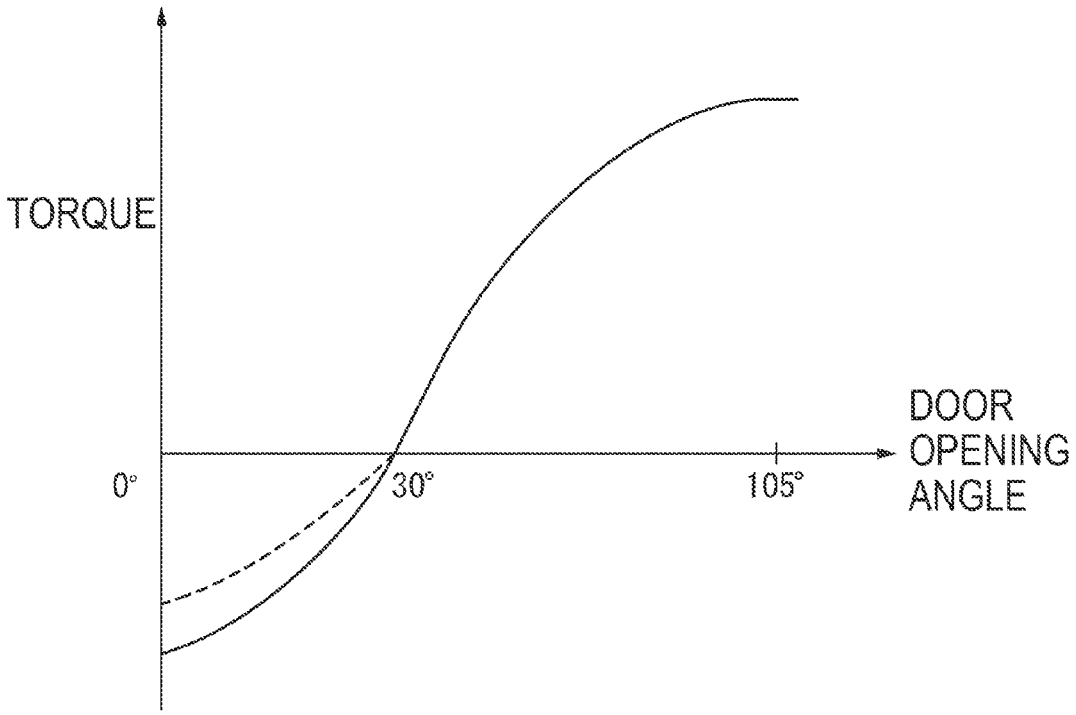
FIG. 14 illustrates a graph showing a relationship between an opening angle of an arm and torque acting on the arm.

FIG. 14 illustrates a graph showing a relationship between the opening angle of the door 12 and the torque acting on the door 12. When the opening angle of the door 12 reaches the predetermined (i.e. 30 degrees) or greater angle, the slider crank mechanism S1 applies the torque in the opening direction to the door 12. The torque increases sinusoidally as the opening angle of the door 12 increases. Therefore, it becomes easy to open the door 12. On the other hand, when the opening angle of the door is smaller than the predetermined angle, by switching from the second slider pivoting shaft 25*b* to the first slider pivoting shaft 25*a*, it is possible to reduce the torque acting on the door 12 in the closing direction from a solid line to a broken line in the graph. Therefore, it becomes easy to open the closed door 12.

Figure 15A:
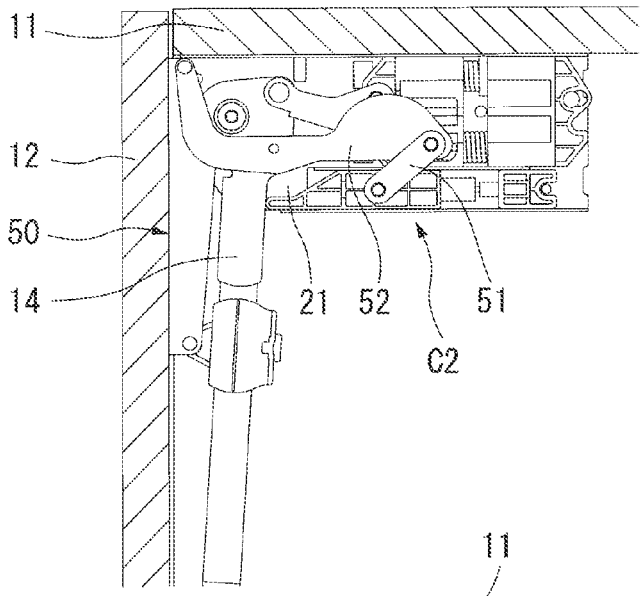
FIGS. 15(*a*) to 15(*c*) illustrate side views of a door opening and closing device according to a fourth embodiment of the invention (FIG. 15(*a*) illustrates a closed state of a door, FIG. 15(*b*) illustrates a state in which the door is open a predetermined or greater angle, and FIG. 15(*c*) illustrates an open state of the door).
Figure 15B:
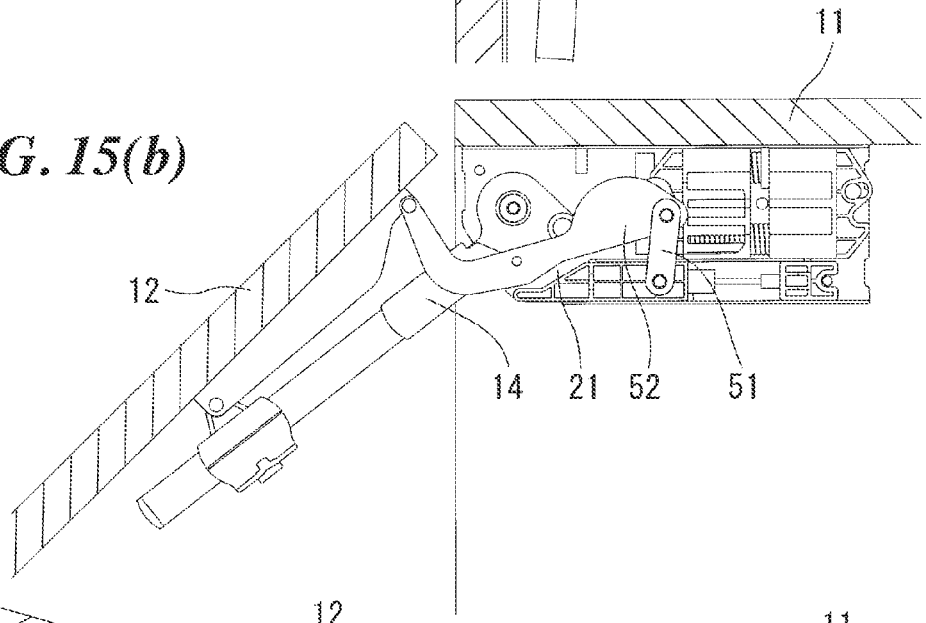
Figure 15C:
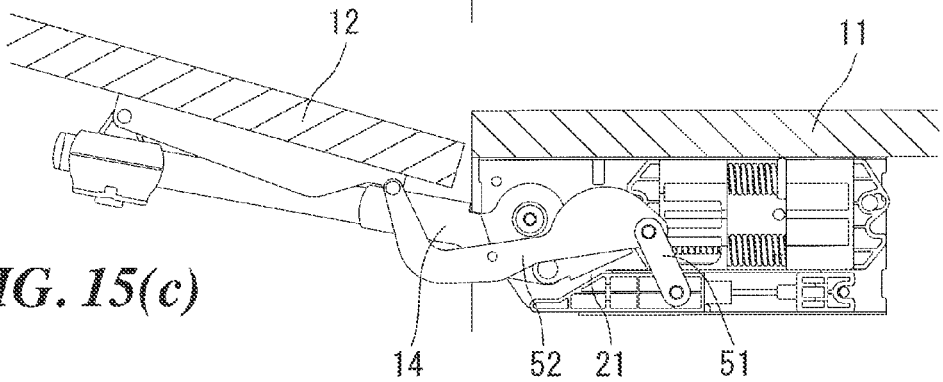
Figure 16:
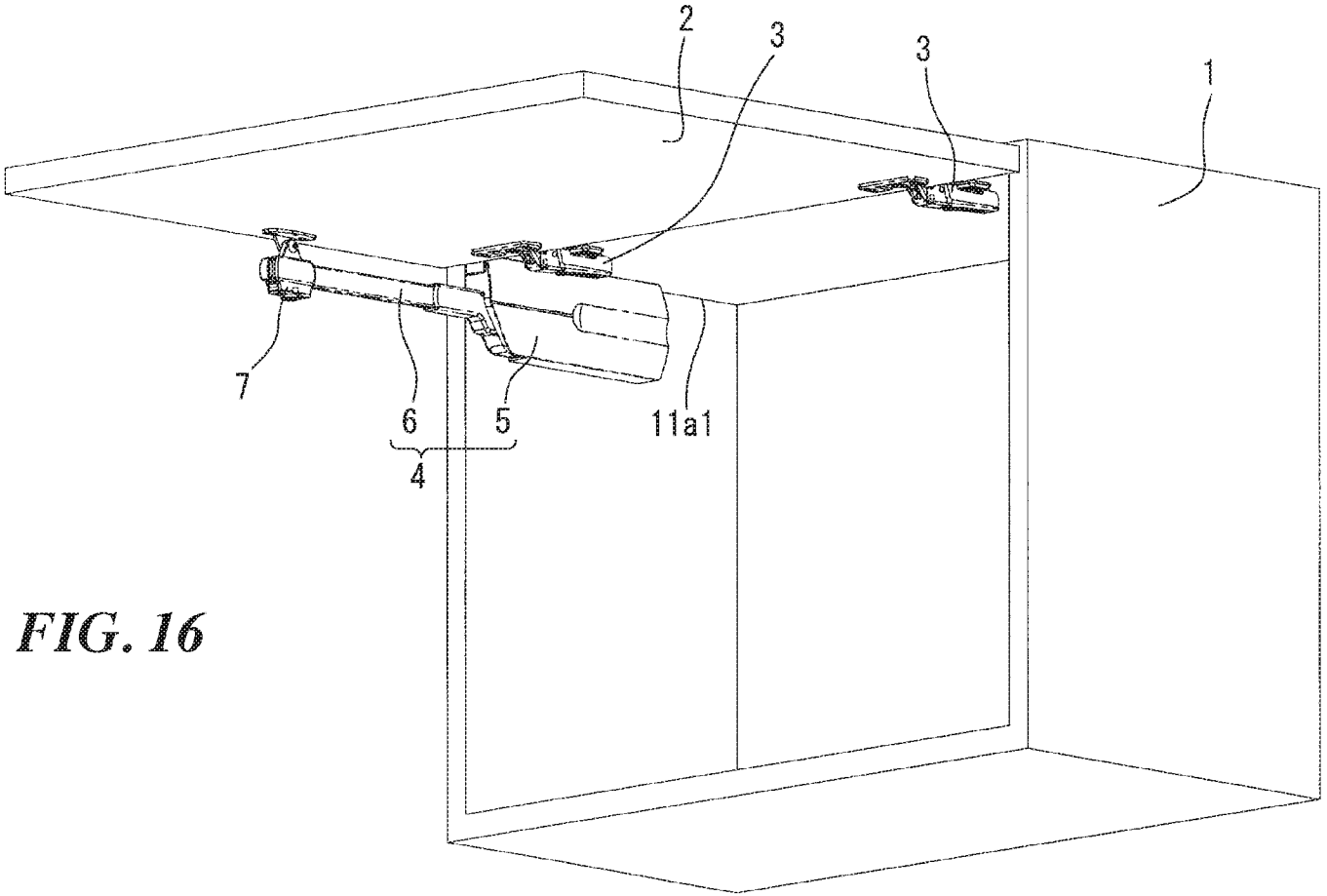
FIG. 16 illustrates a perspective view of a conventional door opening and closing device.

FIGS. 15(*a*) to 15(*c*) illustrate a door opening and closing device 50 according to a fourth embodiment of the invention. While the door restraint links 15 are slidably and pivotably linked to the slider 27 in the third embodiment, the door opening and closing device 50 in the fourth embodiment is different from the door opening and closing device 20 in the third embodiment in that door restraint links 52 are linked to a case 21 via auxiliary links 51. One end portions of the auxiliary links 51 are pivotably linked to the case 21. The other end portions of the auxiliary links 51 are pivotably linked to the door restraint links 52. Because the other structures are the same as those of the door opening and closing device 20 according to the third embodiment, they will be provided with the same reference signs and will not be described.

The door restraint links 52, the arm 14, the case 21, and the auxiliary links 51 form a second chain C2 in FIG. 6. All the four links form the link with turning pairs. If the second chain C2 is formed by a quadric crank chain as in this embodiment, the door restraint links 52 cause the door 12 to move in a certain manner.

As illustrated in FIG. 15(*a*), in a closed state of the door 12, a force in the closing direction is further applied to the door 12. As illustrated in FIG. 15(*b*), if the door 12 in the closed state is opened a predetermined or greater angle, a force in the opening direction is applied to the door 12. As illustrated in FIG. 15(*c*), in the open state of the door 12, the force in the opening direction is further applied to the door 12.

The invention is not limited to those embodied in the above-described embodiments and can be embodied in various embodiments without departing from the gist of the invention.

Although the invention is applied to the upward opening flap door which pivots about the horizontal axis at an upper portion of the housing in the example described in each of the above-described embodiments, the invention can be also applied to a downward opening flap door which pivots about a horizontal axis at a lower portion of a housing. The invention can be also applied to a folding flap door formed by connecting two doors by use of hinges.

Although the door restraint links and the slider overlap each other when seen in the direction of the pivotal axis of the arms from the closed state to the open state of the door in each of the above-described embodiments, the door restraint links and the slider may overlap each other only in a certain range between the closed state and the open state of the door.

In each of the above-described embodiments, the elongated holes are formed in the door restraint links and the shaft inserted through the elongated holes is provided to the slider or the case. However, a shaft may be provided to door restraint links and (an) elongated hole(s) may be provided to a slider or a case.

The shapes of the door restraint links, the arms, the force applying links, the slider, the mounting member, and the like in the above-described embodiments are merely examples and can be changed suitably according to size, weight, and a manner of opening of the door.

Although the mounting member main body is formed by the single part in each of the above-described embodiments, a mounting member main body may be formed by two parts including a first split body linked to door restraint links and a second split body linked to arms.

Although the case of the door opening and closing device is attached to the inner face of the side plate of the housing in each of the above-described embodiments, a case may be attached to an outer face of a side plate of a housing. If the case is attached to the outer face of the side plate of the housing, arms and door restraint links do not obstruct housing and it becomes easy to house objects in the housing.

The present description is based on Japanese Patent Application No. 2012-210302 filed on Sep. 25, 2012, all contents of which are incorporated herein.

REFERENCE SIGNS LIST

11 . . . housing
11*a* . . . inner face
12 . . . door
13 . . . mounting member
14 . . . arm
15 . . . door restraint link
18 . . . coil spring (urging means)
20 . . . door opening and closing device
21 . . . case (main opening and closing device body)
22 . . . first shaft, arm shaft (arm shaft)
24 . . . force applying link (transmission mechanism)
27 . . . slider
50 . . . door opening and closing device
51 . . . auxiliary link
52 . . . door restraint link
60 . . . door opening and closing device
61 . . . housing
61*a* . . . side plate
62 . . . door
64 . . . case (main opening and closing device body)
65 . . . mounting member
66 . . . arm
66*b* . . . roller
67 . . . door restraint link
67*a* . . . elongated hole in door restraint link
70 . . . cam (transmission mechanism)
71 . . . slider
71*a* . . . elongated hole in slider
71*c* . . . recessed portion of slider
72*a* to 72*c* . . . coil spring (urging means)
75*a* . . . shaft
76 . . . arm shaft
84 . . . damper
84*a* . . . main body portion of damper
84*b* . . . shaft portion of damper

The invention claimed is:

1. A door opening and closing device comprising:

a main opening and closing device body attached to a housing;

a mounting member attached to a door;

an arm pivotably provided to the main opening and closing device body, the arm being pivotably linked to the mounting member and slidable relative to the mounting member, the arm applying force to the door in an opening direction and/or a closing direction, the arm having a center of pivot;

a slider provided to the main opening and closing device body so as to be slidable in a first direction and in an opposite, second direction;

an urging means for urging the slider in the first direction;

a transmission mechanism for transmitting urging force of the urging means to the arm; and a door restraint link pivotably linked to the arm at a position spaced apart from the center of pivot of the arm, pivotably linked to the mounting member, and slidably linked to the main opening and closing device body or the slider so that the door opens, wherein the door restraint link and the slider overlap each other when seen in an axial direction of a pivotal axis of the arm.

2. The door opening and closing device according to claim 1, wherein a shaft is provided to the main opening and closing device body and elongated holes through which the shaft is inserted are formed in the door restraint link.

3. The door opening and closing device according to claim 1, wherein a recessed portion is formed in a side face of the slider and the door restraint link is housed in the recessed portion of the slider.

4. The door opening and closing device according to claim 3, wherein the urging means is one or more coil springs and a portion of the slider where the recessed portion is formed has a smaller width than an outer diameter of at least one of the coil springs when the slider is seen in a section orthogonal to the first direction.

5. The door opening and closing device according to claim 1 further comprising an expanding and contracting damper in which a damper shaft portion moves in the first direction and the second direction relative to a main body portion, wherein one of the main body portion and the damper shaft portion comes in contact with the arm and the other of the main body portion and the damper shaft portion comes in contact with the slider.

6. The door opening and closing device according to claim 1, wherein the transmission mechanism is a cam provided to the slider and a roller for coming in contact with the cam is provided to the arm.

7. The door opening and closing device according to claim 1, wherein the door is a flap door which can pivot about a horizontal axis, the main opening and closing device body is attached to a side plate of the housing, and the mounting member is attached to a back face of the flap door.

8. The door opening and closing device according to claim 2, wherein a recessed portion is formed in a side face of the slider and the door restraint link is housed in the recessed portion of the slider.

9. A door opening and closing device comprising:

a main opening and closing device body attached to a housing;

a mounting member attached to a door;

an arm pivotably provided to the main opening and closing device body, the arm being pivotably linked to the mounting member via an auxiliary link, the arm applying force to the door in an opening direction and/or a closing direction, the arm having a center of pivot, a slider provided to the main opening and closing device body so as to be slidable in a first direction and in an opposite, second direction;

an urging means for urging the slider in the first direction;

a transmission mechanism for transmitting urging force of the urging means to the arm; and a door restraint link pivotably linked to the arm at a position spaced apart from the center of pivot of the arm, pivotably linked to the mounting member, and slidably linked to the main opening and closing device body or the slider so that the door opens, wherein the door restraint link and the slider overlap each other when seen in an axial direction of a pivotal axis of the arm.

10. The door opening and closing device according to claim 9, wherein a shaft is provided to the main opening and closing device body, and elongated holes through which the shaft is inserted are formed in the door restraint link.

11. The door opening and closing device according to claim 9, wherein a recessed portion is formed in a side face of the slider, and the door restraint link is housed in the recessed portion of the slider.

12. The door opening and closing device according to claim 9, wherein the urging means is one or more coil springs, and a portion of the slider where the recessed portion is formed has a smaller width than an outer diameter of at least one of the coil springs when the slider is seen in a section orthogonal to the first direction.

13. The door opening and closing device according to claim 9 further comprising an expanding and contracting damper in which a damper shaft portion moves in the first direction and the second direction relative to a main body portion, wherein one of the main body portion and the damper shaft portion comes in contact with the arm and the other of the main body portion and the damper shaft portion comes in contact with the slider.

14. The door opening and closing device according to claim 9, wherein the transmission mechanism is a cam provided to the slider, and a roller for coming in contact with the cam is provided to the arm.

15. The door opening and closing device according to claim 9, wherein the door is a flap door which can pivot about a horizontal axis, the main opening and closing device body is attached to a side plate of the housing, and the mounting member is attached to a back face of the flap door.

16. A door opening and closing device comprising:

a main opening and closing device body attached to a housing;

a mounting member attached to a door;

an arm pivotably provided to the main opening and closing device body, the arm being pivotably linked to the mounting member and slidable relative to the mounting member, the arm applying force to the door in an opening direction and/or a closing direction, the arm having a center of pivot;

a slider provided to the main opening and closing device body so as to be slidable in a first direction and in an opposite, second direction;

an urging means for urging the slider in the first direction;

a transmission mechanism for transmitting urging force of the urging means to the arm; and a door restraint link pivotably linked to the arm at a position spaced apart from the center of pivot of the arm, pivotably linked to the mounting member, and linked to the main opening and closing device body via an auxiliary link so that the door opens, wherein the door restraint link and the slider overlap each other when seen in an axial direction of a pivotal axis of the arm.

17. The door opening and closing device according to claim 16, wherein the door is a flap door which can pivot about a horizontal axis, the main opening and closing device body is attached to a side plate of the housing, and the mounting member is attached to a back face of the flap door.

* * * * *